US006559817B1

(12) United States Patent
Lee et al.

(10) Patent No.: US 6,559,817 B1
(45) Date of Patent: May 6, 2003

(54) METHOD FOR DRIVING PLASMA DISPLAY PANEL

(75) Inventors: Seong-charn Lee, Seoul (KR); Jeong-duk Ryeom, Cheonan (KR); Kyoung-ho Kang, Asan (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 136 days.

(21) Appl. No.: 09/678,729

(22) Filed: Oct. 4, 2000

(30) Foreign Application Priority Data

Oct. 26, 1999 (KR) ..... 99-46620

(51) Int. Cl.[7] ..... G09G 3/28
(52) U.S. Cl. ..... 345/68; 345/67
(58) Field of Search ..... 315/169.4; 345/60, 345/61, 62, 63, 64, 65, 66, 67, 68, 69, 70, 71, 72

(56) References Cited

U.S. PATENT DOCUMENTS 5,663,741 A * 9/1997 Kanazawa ..... 345/66
5,835,072 A * 11/1998 Kanazawa ..... 345/60
5,874,932 A * 2/1999 Nagaoka et al. ..... 345/60
6,011,355 A * 1/2000 Nagai ..... 315/169.3
6,020,687 A * 2/2000 Hirakawa et al. ..... 385/135
6,172,662 B1 * 1/2001 Ito et al. ..... 345/94
6,184,848 B1 * 2/2001 Weber ..... 345/60
6,188,374 B1 * 2/2001 Moon ..... 345/60
6,243,084 B1 * 6/2001 Nagai ..... 345/210
6,256,002 B1 * 7/2001 Shinoda ..... 345/60
6,271,811 B1 * 8/2001 Shimizu et al. ..... 345/68
6,288,693 B1 * 9/2001 Song et al. ..... 345/68
6,326,736 B1 * 12/2001 Kang et al. ..... 315/169.4
6,496,163 B1 * 12/2002 Iseki ..... 345/60

* cited by examiner

*Primary Examiner*—Steven Saras
*Assistant Examiner*—Leland R. Jorgensen
(74) *Attorney, Agent, or Firm*—Leydig, Voit & Mayer, Ltd.

(57) ABSTRACT

A method for driving a plasma display panel having front and rear substrates opposed to and facing each other, X and Y electrode lines between the front and rear substrates, parallel to each other, and address electrode lines orthogonal to the X and Y electrode lines, defining corresponding pixels at intersections. A scan pulse is sequentially applied to the respective Y electrode lines at a predetermined time difference and the corresponding display data signals are simultaneously applied to the respective address electrode lines to produce wall charges at pixels where a discharge display discharge is to take place and pulses for a display discharge are alternately applied to the X and Y electrode lines to cause a display discharge at the pixels where the wall charges have been produced. The scan pulse is progressively applied between pulses for a display discharge, to the corresponding Y electrode lines of subfields set as driving periods for time-division gray scale display, and the voltage of the display data signal applied to the pixels where a discharge display is to take place as a time difference between (i) the first pulse, among the pulses for a display discharge and (ii) the pulse of the display data signal applied to the pixels where a discharge display is to take place before application of the first pulse, becomes larger.

2 Claims, 6 Drawing Sheets

METHOD FOR DRIVING PLASMA DISPLAY PANEL

BACKGROUND OF THE INVENTION

1. Field of the Invention

The present invention relates to a method for driving a plasma display panel, and more particularly, to a method for driving a three-electrode surface-discharge plasma display panel.

2. Description of the Related Art

FIG. 1 shows a structure of a general three-electrode surface-discharge plasma display panel, FIG. 2 shows an electrode line pattern of the panel shown in FIG. 1, and FIG. 3 shows an example of a pixel of the panel shown in FIG. 1. Referring to the drawings, address electrode lines $A_1$, $A_2$, . . . , $A_{m-1}$ and $A_m$, dielectric layers 11 and 15, Y electrode lines $Y_1$, . . . , and $Y_n$, X electrode lines $X_1$, . . . , and $X_n$, phosphors 16, partition walls 17 and a MgO protective film 12 are provided between front and rear glass substrates 10 and 13 of a general surface-discharge plasma display panel 1.

The address electrode lines $A_1, A_2, \ldots, A_{m-1}$ and $A_m$ are coated over the front surface of the rear glass substrate 13 in a predetermined pattern. The lower dielectric layer 15 entirely coats the front surface of the address electrode lines $A_1, A_2, \ldots, A_{m-1}$ and $A_m$. The partition walls 17 on the front surface of the lower dielectric layer 15 are parallel to the address electrode lines $A_1$, $A_2$, . . . , $A_{m-1}$ and $A_m$. The partition walls 17 define discharge areas of the respective pixels and prevent optical crosstalk among pixels. The phosphors 17 coat the partition walls 17.

The X electrode lines $X_1$, . . . and $X_n$ and the Y electrode lines $Y_1$, . . . and $Y_n$ are arranged on the rear surface of the front glass substrate 10 and are orthogonal to the address electrode lines $A_1, A_2, \ldots, A_{m-1}$ and $A_m$ in a predetermined pattern. The respective intersections define corresponding pixels. The X electrode lines $X_1$, . . . and $X_n$ and the Y electrode lines $Y_1$, . . . and $Y_n$ each comprise conductive indium tin oxide (ITO) electrode lines ($X_{na}$ and $Y_{na}$ of FIG. 3) and metal bus electrode lines ($X_{nb}$ and $Y_{nb}$ of FIG. 3). The upper dielectric layer 11 entirely coats the rear surface of the X electrode lines $X_1$, . . . and $X_n$ and the Y electrode lines $Y_1$, . . . and $Y_n$. The MgO protective film 12 for protecting the panel 1 against strong electrical fields entirely coats over the rear surface of the upper dielectric layer 11. A gas for forming a plasma is hermetically sealed in a discharge space 14.

The above-described plasma display panel is basically driven such that a reset step, an address step and a sustain-discharge step are sequentially performed in a unit subfield. In the reset step, wall charges remaining in the previous subfield are erased and space charges are evenly formed. In the address step, the wall charges are formed in a selected pixel area. Also, in the sustain-discharge step, light is produced at the pixel at which the wall charges are formed in the address step. In other words, if alternating pulses of a relatively high voltage are applied between the X electrode lines $X_1$, . . . and $X_n$ and the Y electrode lines $Y_1$, . . . and $Y_n$, a surface discharge occurs at the pixels at which the wall charges are formed. Here, plasma is formed at the gas layer of the discharge space 14 and the phosphors 142 are excited by ultraviolet rays and thus emit light.

FIG. 4 shows the structure of a unit display period based on a driving method of a general plasma display panel. Here, a unit display period represents a frame in a progressive scanning method, and a field in the case of an interlaced scanning method. The driving method shown in FIG. 4 is generally referred to as a multiple address overlapping display driving method. According to this driving method, pulses for a display discharge are consistently applied to all X electrode lines $X_1$, . . . and $X_n$ and all Y electrode lines $Y_1$, . . . and $Y_n$, and pulses for resetting or addressing are applied between the respective pulses for a display discharge. Here, the pulses for resetting or addressing are applied to the Y electrode lines corresponding to a plurality of subfields $SF_1$, . . . and $SF_8$ set as driving periods for the purpose of displaying gray scales in a time-divisional manner.

Thus, compared to an address-display separation driving method, the multiple address overlapping display driving method has an enhanced display luminance. Here, the address-display separation driving method refers to a method in which, within a unit subfield, reset and address steps are performed for all Y electrode lines $Y_1$, . . . and $Y_n$, during a certain period and a display discharge step is then performed.

Referring to FIG. 4, a unit field or frame is divided into 8 subfields $SF_1$, . . . and $SF_8$ for achieving a time-divisional gray scale display. Also, in each subfield, reset, address and sustain-discharge steps are performed, and the time allocated to each sub-field is determined by the display discharge time corresponding to gray scales. For example, in the case of displaying 256 gray scales with 8-bit image data in units of frames, assuming that a unit frame, generally 1/60 sec consists of 256 unit times, the first subfield $SF_1$ driven by the image data of the least significant bit has 1 ($2^0$) unit time, the second subfield $SF_2$ 2 ($2^1$) unit times, the third subfield $SF_3$ 4 ($2^2$) unit times, the fourth subfield $SF_4$ 8 ($2^3$) unit times, the fifth subfield $SF_5$ 16 ($2^4$) unit times, the sixth subfield $SF_6$ 32 ($2^5$) unit times, the seventh subfield $SF_7$ 64 ($2^6$) unit times, and the eighth subfield $SF_8$ driven by the image data of the most significant bit 128 ($2^7$) unit time, respectively. In other words, since the sum of the unit times allocated to the respective subfields is 255 unit times, it is possible to achieve 255 gray scale display, and 256 gray scale display inclusive of one gray scale in which a no display discharge occurs at any subfield.

If an address step is performed for a Y electrode line and then a display discharge step is performed in the first subfield $SF_1$, an address step is performed for the corresponding Y electrode line at the second subfield $SF_2$. The same procedure is applied to subsequent subfields $SF_3$, . . . and $SF_8$. For example, if an address step is performed for a corresponding Y electrode line and then a display discharge step is performed in the seventh subfield $SF_7$, an address step is performed for the corresponding Y electrode line at the eighth subfield $SF_8$. Although the time for a unit subfield equals the time for a unit field or frame, the respective unit subfields are overlapped on the basis of driven Y electrode lines $Y_1$, . . . and $Y_{480}$ to form a unit field or frame. Thus, since all subfields $SF_1$, . . . and $SF_8$ exist at every timing, time slots for addressing, depending on the number of subfields, are set between the respective display discharge pulses for the purpose of performing the respective address steps.

As one of the above-described multiple address overlapping display driving methods, a driving method in which address steps are performed in the order of Y electrode lines corresponding to the respective subfields between pulses for each. display discharge, is generally used. In this driving method, conventionally, a constant voltage of pulses of display data signals are applied to the address electrode lines selected in accordance with the respective Y electrode lines scanned in the order of the respective subfields. However, since the scanning timings for the respective subfields are different, the standby times required for wall charges which have been formed on the respective Y electrode lines waiting for the pulses for the first display discharge, are different. As the standby time becomes longer, many more of the wall charges which have been formed at the pixels to be displayed are removed. Therefore, according to the conventional driving method, it is quite highly probable that only pixels to be displayed at subfields having the first scanning time slot, for example, the first subfield $SF_1$ and the fifth subfield $SF_5$, will be consistently displayed. Thus, uniformity and stability of a display may be deteriorated.

SUMMARY OF THE INVENTION

To solve the above problem, it is an object of the present invention to provide a method for driving a plasma display panel which can increase the uniformity and stability of a display by preventing a phenomenon in which a display discharge does not occur consistently at to-be-displayed pixels of a specific subfield.

Accordingly, to achieve the above object, there is provided a method for driving a plasma display panel having front and rear substrates opposed to and facing each other, X and Y electrode lines formed between the front and rear substrates to be parallel to each other and address electrode lines formed to be orthogonal to the X and Y electrode lines, to define corresponding pixels at interconnections, such that wherein a scan pulse is applied to the respective Y electrode lines with a predetermined time difference and the corresponding display data signals are simultaneously applied to the respective address electrode lines to form wall charges at pixels to be displayed and pluses for a display discharge are alternately applied to the X and Y electrode lines to cause a display discharge at the pixels where the wall charges have been formed. Here, the scan pulse is progressively applied between pulses for a display discharge, to the corresponding Y electrode lines of a plurality of subfields set as driving periods for time-divisional gray scale display, and the voltage of the display data signal applied to the pixels to be displayed as a time difference between the first pulse among the pulses for a display discharge and the pulse of the display data signal applied to the pixels to be displayed before application of the first pulse, becomes larger.

Therefore, since a phenomenon in which a display discharge does not occur consistently at to-be-displayed pixels of a specific subfield is prevented by a change in the scanning order of the respective subfields, the uniformity and stability of a display can be increased.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

Figure 1:
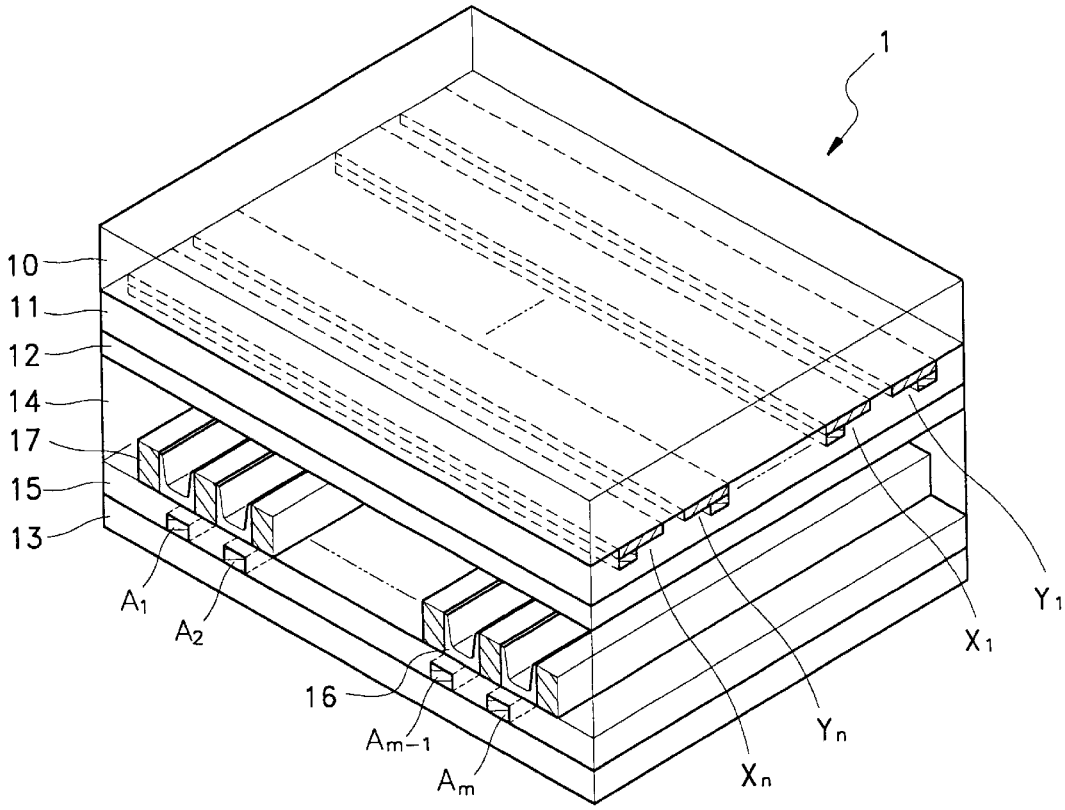
FIG. 1 is an internal perspective view illustrating a structure of a general three-electrode surface-discharge plasma display panel.
Figure 2:
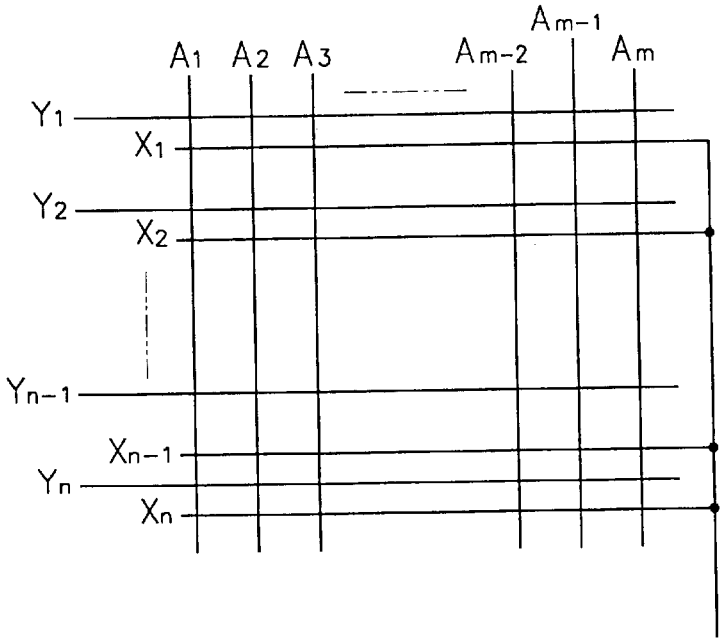
FIG. 2 shows an electrode line pattern of the panel shown in FIG. 1.
Figure 3:
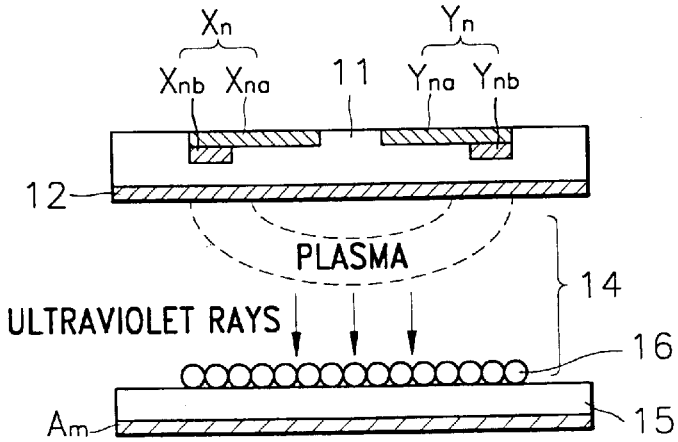
FIG. 3 is a cross section of an example of a pixel of the panel shown in FIG. 1.
Figure 4:
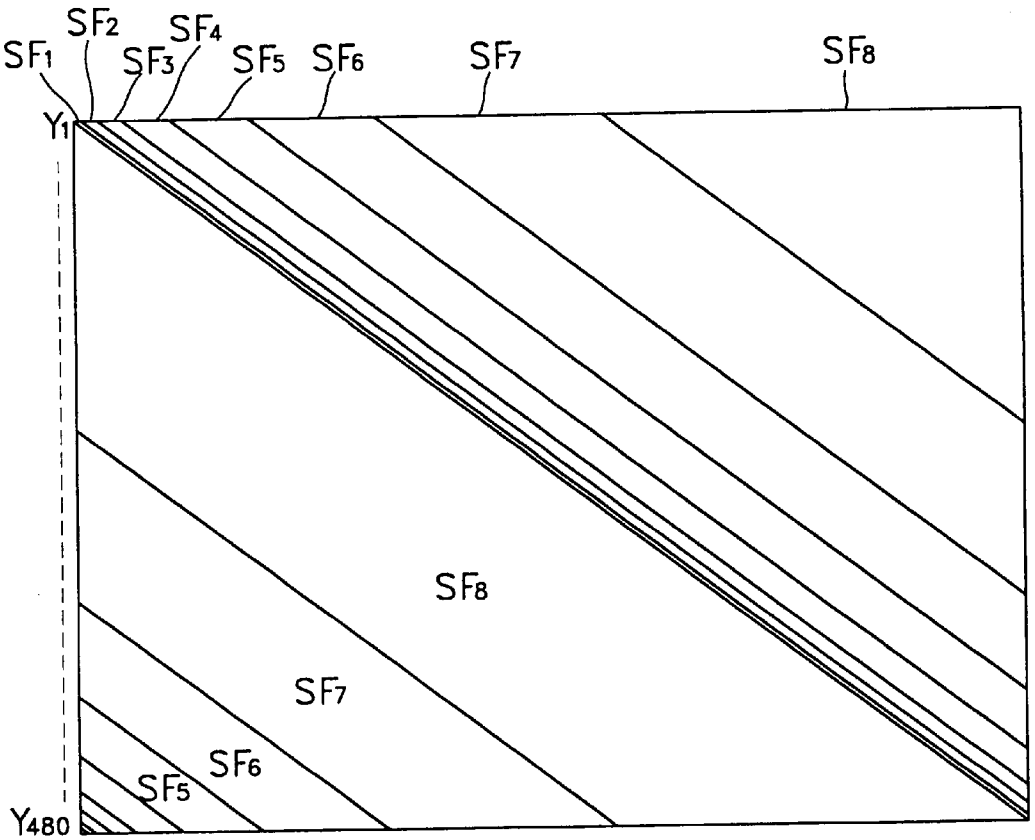
FIG. 4 is a timing diagram showing the structure of a unit display period based on the driving method of a general plasma display panel.
Figure 5:
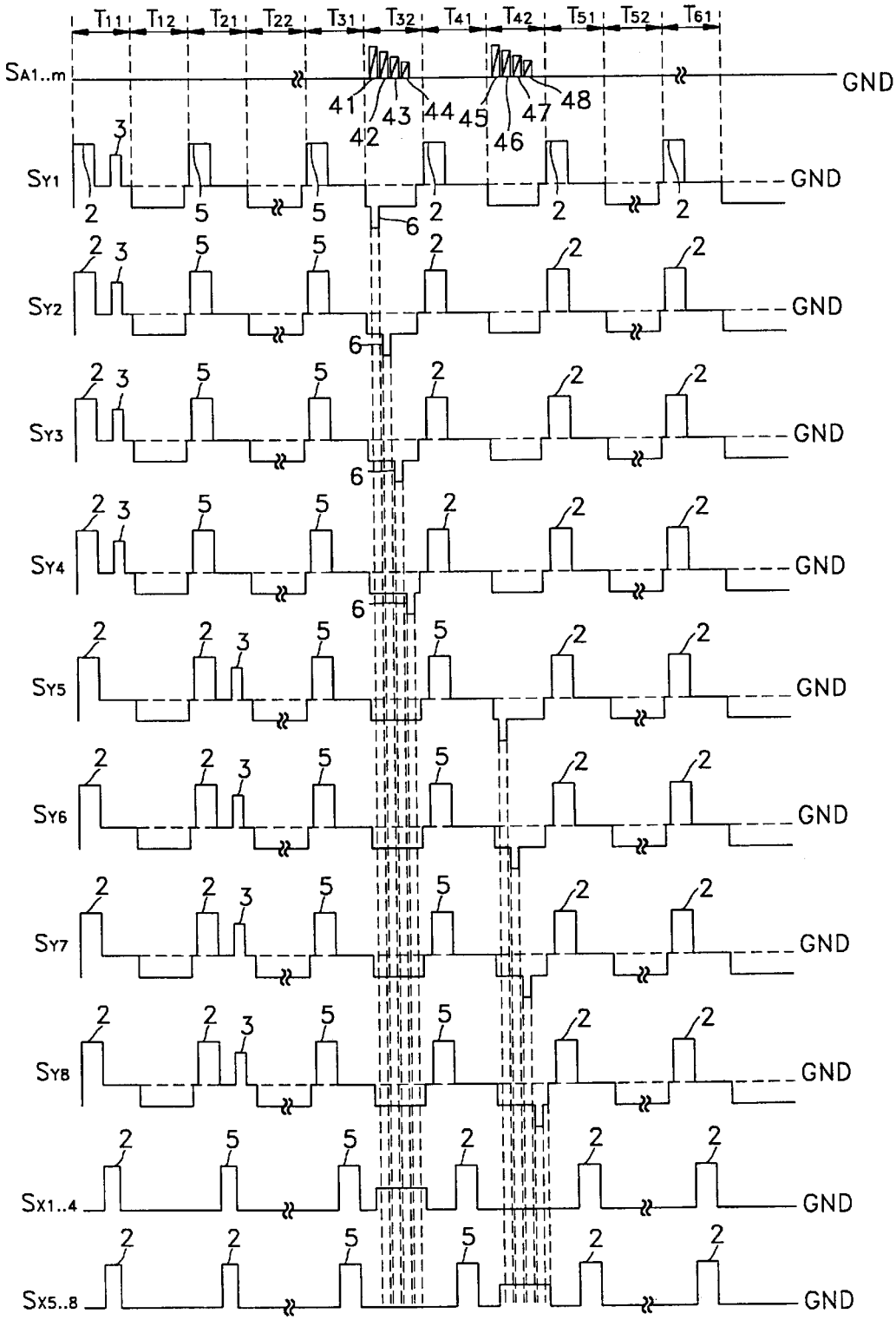
FIG. 5 is a waveform diagram of driving signals in a unit field or frame based on a driving method according to the present invention.

FIG. 5 shows driving signals in a unit field or frame based on a driving method according to the present invention. In FIG. 5, $S_{Y1}$, . . . and $S_{Y8}$ denote driving signals applied to the corresponding Y electrode lines of the respective subfields. In more detail, $S_{Y1}$ denotes a driving signal applied to a Y electrode line of the first subfield ($SF_1$ of FIG. 4), $S_{Y2}$ a driving signal applied to a Y electrode line of the second subfield ($SF_2$ of FIG. 4), $S_{Y3}$ a driving signal applied to a Y electrode line of the third subfield ($SF_3$ of FIG. 4), $S_{Y4}$ a driving signal applied to a Y electrode line of the fourth subfield ($SF_4$ of FIG. 4), $S_{Y5}$ a driving signal applied to a Y electrode line of the fifth subfield ($SF_5$ of FIG. 4), $S_{Y6}$ a driving signal applied to a Y electrode line of the sixth subfield ($SF_6$ of FIG. 4), $S_{Y7}$ a driving signal applied to a Y electrode line of the seventh subfield ($SF_7$ of FIG. 4), and $S_{Y8}$ a driving signal applied to a Y electrode line of the eighth subfield ($SF_8$ of FIG. 4), respectively. $S_{X1 \ldots 4}$ and $S_{X5 \ldots 8}$ denote driving signals applied to X electrode line groups corresponding to scanned Y electrode lines, $S_{A1 \ldots m}$ denotes a display data signal applied to all address electrode lines ($A_1$, . . . and $A_m$ of FIG. 1), and GND denotes a ground voltage.

Figure 6:
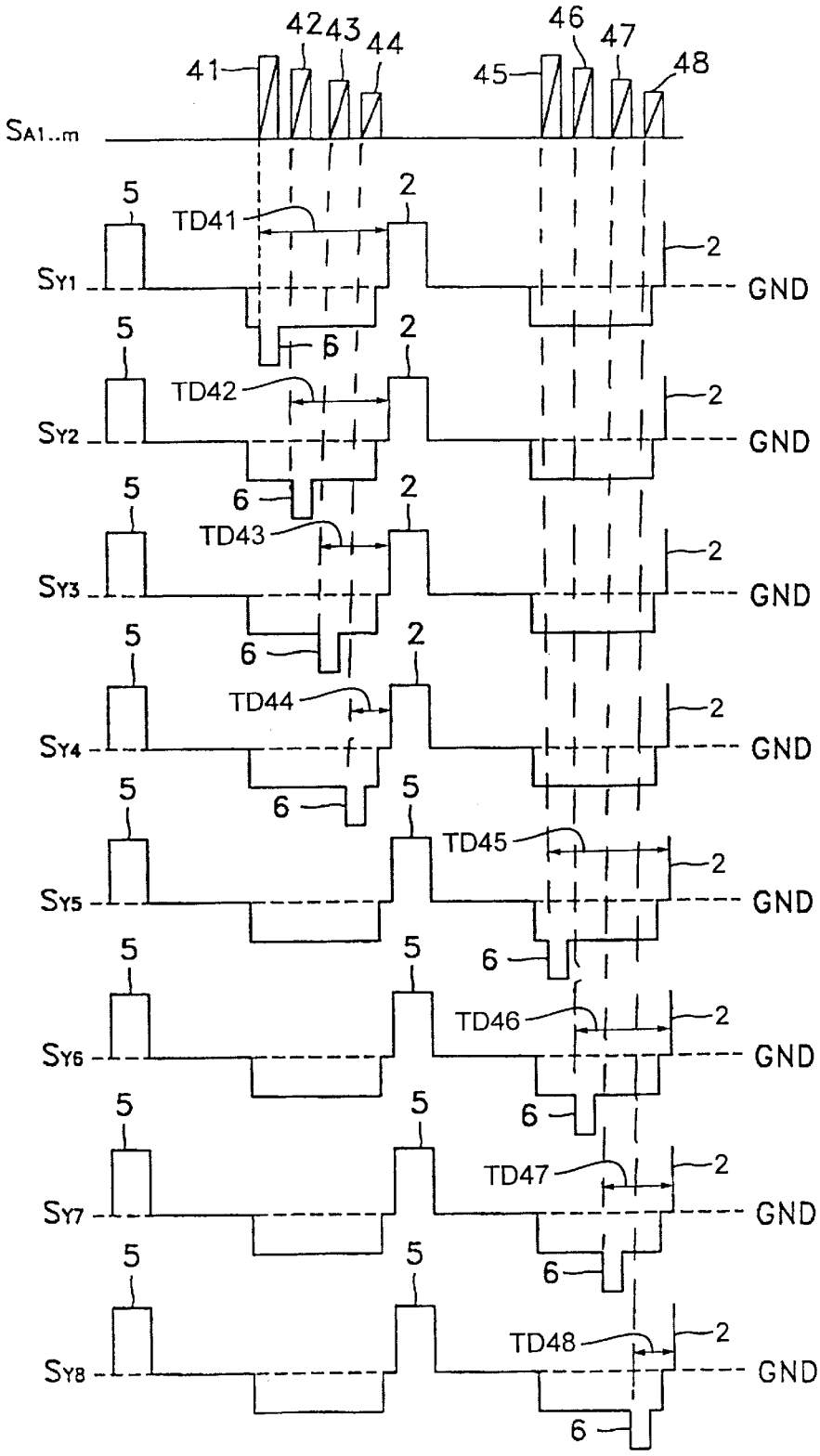
FIG. 6 is a detailed waveform diagram of driving signals applied to corresponding Y electrode lines of the respective subfields during periods $T_{31}$ to $T_{42}$ shown in FIG. 5.

FIG. 6 shows in more detail driving signals $S_{Y1}$, . . . and $S_{Y8}$ applied to the corresponding Y electrode lines of the respective subfields in time periods $T_{31}$ to $T_{42}$ shown in FIG. 5.

Referring to FIGS. 5 and 6, a scan pulse 6 is progressively applied to Y electrode lines corresponding to a plurality of subfields $SF_1$, . . . and $SF_8$ between pulses 2 and 5 for a display co discharge. Also, the larger a time difference between the first pulse 2 and pulses 41 through 48 of the display data signal $S_{A1 \ldots m}$ applied to the to-be-displayed pixels before application of the first pulse 2, the higher the voltage of the pulses 41 through 48 of the display data signal $S_{A1 \ldots m}$ applied to the to-be-displayed pixels. In more detail, the voltage of the pulses 41 and 45 of the display data signals corresponding to the first and fifth subfields $SF_1$ and $SF_5$, having the time slots in which scanning is done first, that is, which are most remote in time, by time differences TD41 and TD45, respectively, from the corresponding pulse 2 for a display discharge, is highest, among the pulses of the display data signals. The voltage of the pulses 42 and 46 of the display data signals corresponding to the second and sixth subfields $SF_2$ and $SF_6$, having the time slots in which scanning is done second, and time differences TD42 and TD46, is second highest. The voltage of the pulses 43 and 47 of the display data signals corresponding to the third and seventh subfields $SF_3$ and $SF_7$ having the time slots in which scanning is done third, and time differences TD43 and TD 47, is third highest. The voltage of the pulses 44 and 48 of the display data signals corresponding to the fourth and eighth subfields $SF_4$ and $SF_8$, having the time slots in which scanning is done last, that is, which are closest in time to the pulse 2 for a display discharge, with time differences TD44 and TD48, is lowest.

Accordingly, since a phenomenon in which a display discharge does not occur consistently at to-be-displayed pixels of a specific subfield is prevented by changing the scanning order of the respective subfields, the uniformity and stability of a display can be increased.

The pulses 2 and 5 for a display discharge are consistently applied to the X electrode lines ($X_1$, . . . and $X_n$ of FIG. 1) and all the Y electrode lines $Y_1$, . . . and $Y_{480}$, and the resetting pulse 3 or scan pulse 6 is applied between the pulses 2 and 5 for each display discharge.

There exists a predetermined quiescent period until the scan pulse 6 is applied after the reset pulse 3 was applied, so that space charges are smoothly distributed at the corresponding pixel areas. In FIG. 5, time periods $T_{12}$, $T_{21}$, $T_{22}$ and $T_{31}$ denote quiescent periods corresponding to Y electrode line groups of the first through fourth subfields, and time periods $T_{22}$, $T_{31}$, $T_{32}$ and $T_{41}$ denote quiescent periods corresponding to Y electrode line groups of the fifth through eighth subfields. The pulses 5 for a display discharge applied during the respective quiescent periods cannot actually cause a display discharge but allow space charges to be smoothly distributed at the corresponding pixel areas. However, the pulses 2 for a display discharge applied during periods other than the quiescent periods cause a display discharge at the pixels where wall charges have been produced by the scan pulse 6 and the display data signal $S_{A1 \ldots m}$.

Between the last pulses, among the pulses 5 for a display discharge applied during the quiescent periods, and the first pulses 2 for a display discharge, subsequent to the last pulses, addressing is performed four times. For example, addressing is performed for the Y electrode line group corresponding to the first through fourth subfields during a time period $T_{32}$. Also, addressing is performed for the Y electrode line group corresponding to the fifth through eighth subfields during a time period $T_{42}$. As described above with reference to FIG. 4, since all subfields $SF_1$, . . . and $SF_8$ exist at every timing, time slots for addressing, depending on the number of subfields are set between the respective pulses for a display discharge for the purpose of performing the respective address steps.

Figure 7:
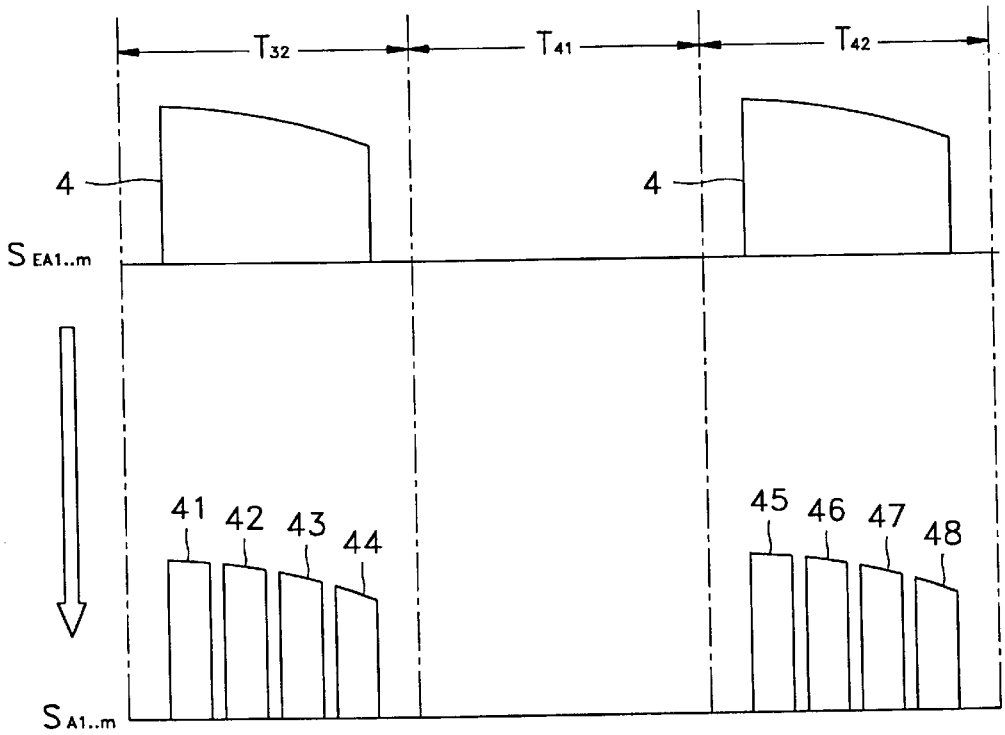
FIG. 7 is a detailed waveform diagram showing a procedure of generating display data signals shown in FIG. 6.

FIG. 7 shows a procedure of generating display data signals shown in FIG. 6. In FIG. 7, the same reference numerals denote the same functional elements as shown in FIG. 6. $S_{EA1 \ldots m}$ denotes a power signal for generating display data signals applied to all address electrode lines $A_1$, $A_2$, . . . , $A_{m-1}$ and $A_m$.

Referring to FIG. 7, the address electrode power signal $S_{EA1 \ldots m}$ generates a pulse 4 having a ground voltage GND at the beginning period of pulses for a display discharge (2 and 5 of FIG. 5), for example, $T_{31}$ or $T_{41}$, and having a voltage which decreases with the passage of time at the latter period in which addressing is performed, for example, $T_{32}$ or $T_{42}$.

The pulses 41 through 48 of the display data signal $S_{A1 \ldots m}$ of the present invention can be easily generated by switching on the pulse 4 according to the addressing time slots set for the respective subfields $SF_1$, . . . and $SF_8$. In other words, the larger a time difference between the first pulse 2 of the pulses 5 and 2 for a display discharge and the pulses 41 through 48 of the display data signal $S_{A1 \ldots m}$ applied to the to-be-displayed pixels before application of the first pulse 2, the higher the voltage of the pulses 41 through 48 of the display data signal $S_{A1 \ldots m}$ applied to the to-be-displayed pixels.

As described above, in the method for driving a plasma display panel according to the present invention, a phenomenon in which a display discharge does not occur consistently at to-be-displayed pixels of a specific subfield can be prevented by changing the voltage of a corresponding display data signal while a scan pulse is applied in the order of the respective subfields, thereby increasing the uniformity and stability of a display.

Although the invention has been described with respect to a preferred embodiment, it is not to be so limited as changes and modifications can be made which are within the full intended scope of the invention as defined by the appended claims.

What is claimed is:

1. A method for driving a plasma display panel having front and rear substrates opposed to and facing each other, X and Y electrode lines between the front and rear substrates, parallel to each other, and address electrode lines orthogonal to the X and Y electrode lines and defining corresponding pixels at intersections of the address electrode lines relative to the X and Y electrode lines, the method comprising:

applying scan pulses sequentially to respective Y electrode lines, and simultaneously applying pulses of a display data signal to respective address electrode lines to produce wall charges at pixels for producing display discharges, and alternately applying pulses for the display discharges at the pixels where the wall charges have been produced, wherein the scan pulses are applied between pulses for the display discharges, to the corresponding Y electrode lines in a plurality of subfields set as driving periods for a time-division gray scale display, and each pulse of the display data signal decreases in voltage as time difference between each pulse of the display data signal and a subsequent pulse for the display discharges decreases.

2. The method according to claim 1, including dividing a pulse having a voltage decreasing with time into a plurality of pulses to produce the pulses of the display data signal.

* * * * *